US008918206B2

(12) United States Patent
Canter et al.

(10) Patent No.: US 8,918,206 B2
(45) Date of Patent: Dec. 23, 2014

(54) SYNCHRONIZATION OF TIME CRITICAL ACTIVITIES ACROSS VENDING MACHINE NETWORKS

(75) Inventors: James M. Canter, Austin, TX (US); William C. Royal, Jr., Oak Ridge, NC (US); Steven Blachman, Pflugerville, TX (US)

(73) Assignee: Crane Merchandising Systems, Inc., Bridgeton, MO (US)

( * ) Notice: Subject to any disclaimer, the term of this patent is extended or adjusted under 35 U.S.C. 154(b) by 258 days.

(21) Appl. No.: 13/457,023

(22) Filed: Apr. 26, 2012

(65) Prior Publication Data

US 2013/0006413 A1 Jan. 3, 2013

Related U.S. Application Data

(60) Provisional application No. 61/479,289, filed on Apr. 26, 2011, provisional application No. 61/479,286, filed on Apr. 26, 2011.

(51) Int. Cl.
*G07F 11/00* (2006.01)
*G07F 9/02* (2006.01)

(52) U.S. Cl.
CPC ..... *G07F 9/023* (2013.01)
USPC ..... 700/241; 700/231; 221/24

(58) Field of Classification Search
USPC ..... 221/24; 700/241, 231, 232, 244
See application file for complete search history.

(56) References Cited

U.S. PATENT DOCUMENTS

| | | | | |
|---|---|---|---|---|
| 4,785,204 | A * | 11/1988 | Terada et al. | 326/104 |
| 6,059,142 | A * | 5/2000 | Wittern et al. | 221/1 |
| 6,250,452 | B1 * | 6/2001 | Partyka et al. | 700/241 |
| 7,697,925 | B1 | 4/2010 | Wilson et al. | |
| 8,155,785 | B2 * | 4/2012 | Hudis | 700/241 |
| 8,255,080 | B2 * | 8/2012 | Hirsh et al. | 700/242 |
| 8,301,301 | B2 * | 10/2012 | Edwards | 700/241 |
| 8,463,430 | B2 * | 6/2013 | Segal et al. | 700/232 |
| 2006/0106490 | A1 | 5/2006 | Howell et al. | |
| 2007/0095901 | A1 | 5/2007 | Illingworth | |
| 2007/0241120 | A1 | 10/2007 | Henry | |
| 2009/0092146 | A1 | 4/2009 | Hargrave et al. | |

OTHER PUBLICATIONS

International Search Report dated Jul. 6, 2012 in connection with International Patent Application No. PCT/US2012/035289.

Written Opinion of the International Searching Authority dated Jul. 6, 2012 in connection with International Patent Application No. PCT/US2012/035289.

* cited by examiner

*Primary Examiner* — Timothy Waggoner

(57) ABSTRACT

Synchronization of activities requiring coordinated timing across a bank of vending machines, such as harmonious actuation of illumination elements, is performed by specifying, in an application layer (e.g., Zigbee) of a network protocol, actions to be synchronized to a distributed timing event and distributing notice of the specified timing event using physical and media access control layers of the network protocol.

20 Claims, 4 Drawing Sheets

SYNCHRONIZATION OF TIME CRITICAL ACTIVITIES ACROSS VENDING MACHINE NETWORKS

CROSS-REFERENCE TO RELATED APPLICATIONS

This application claims priority to U.S. Provisional Patent Application Ser. No. 61/479,289 entitled "SYNCHRONIZATION OF TIME CRITICAL ACTIVITIES ACROSS VENDING MACHINE NETWORKS" and filed on Apr. 26, 2011 and to U.S. Provisional Patent Application Ser. No. 61/479,286 entitled "CUSTOMER USER INTERFACE FOR VENDING MACHINES" and filed on Apr. 26, 2011. The content of the above-identified patent documents are incorporated herein by reference.

TECHNICAL FIELD

The present application relates generally to coordinated operation of multiple vending machines and, more specifically, to synchronization of such coordinated operations.

BACKGROUND

Vending machines offer unattended sales of commodities such as snacks, canned or bottled beverages, or any of a variety of other articles. Many operators will operate a number of different vending machines in conjunction with each other, as for example when a bank of vending machines—some vending snacks or candy and others vending packaged beverages—is placed into operation at a single location, often with the vending machines side-by-side. Coordinating operation of such vending machines is desirable for a variety of reasons, such as offering discounts for "group" purchases including a snack and a beverage or in attracting customer attention to the vending machines.

There is, therefore, a need in the art for improved synchronization of operations within a network of vending machines.

SUMMARY

Synchronization of activities requiring coordinated timing across a bank of vending machines, such as harmonious actuation of illumination elements, is performed by specifying, in an application layer (e.g., Zigbee) of a network protocol, actions to be synchronized to a distributed timing event and distributing notice of the specified timing event using physical and media access control layers of the network protocol.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any bank of suitably arranged vending machines.

Figure 1:
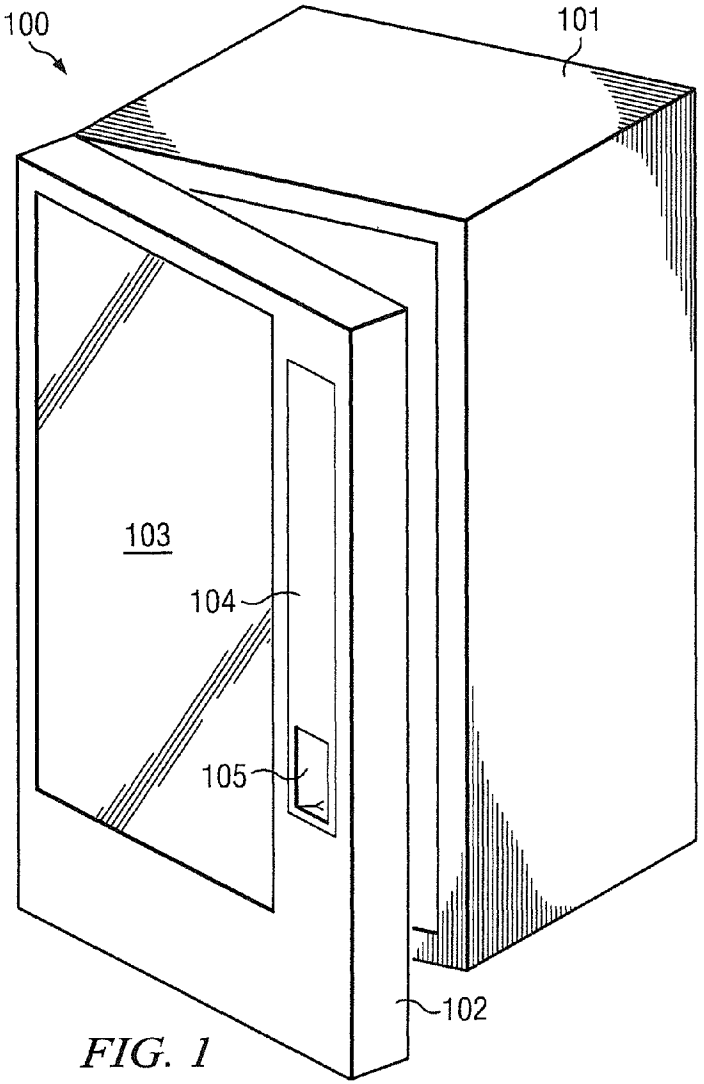
FIG. 1 is a simplified perspective view illustrating a vending machine implementing an intuitive and attractive customer user interface according to one embodiment of the present disclosure.
Figure 2A:
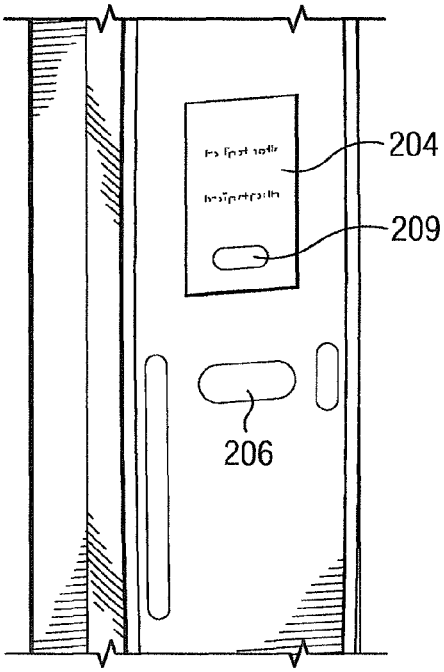
FIG. 2A is an enlarged depiction of a portion of FIG. 2.

FIG. 1 is a simplified perspective view illustrating a vending machine implementing an intuitive and attractive customer user interface according to one embodiment of the present disclosure. Vending machine 100 includes a cabinet 101 and a service door 102 that, together, define an enclosure. In the exemplary embodiment illustrated, the service door 102 is pivotally mounted to the front of the cabinet 101 and extends all the way across the front face of the vending machine 100. In alternate designs, the service door may extend only part way across the front of the vending machine, or may be formed in two portions (of equal or unequal sizes) that swing open in opposite directions.

In the exemplary embodiment illustrated in FIG. 1, the service door 102 includes a transparent front 103 allowing the customer to view actual products available for vending, which may include snacks, packaged beverages, or both.

Vending machine 100 also includes a customer user interface area 104. FIG. 1 depicts an access port 105 to a delivery receptacle mounted within the customer user interface area 104. The access port allows the customer to reach into the delivery receptacle to retrieve a vended product. The access port 105 may have a delivery door or other mechanical system (e.g., rotatable delivery receptacle open on one side) for controlling or restricting access by the customer into the delivery receptacle, the interior of the vending machine, or both. Those skilled in the art will recognize that in some vending machines, particularly helical coil snack vending machines, the access port 105 may be located near the bottom of the vending machine and extend across most of the width of the machine, below the large transparent window allowing the contents within the cabinet to be viewed or a large liquid crystal display selectively presenting images of products available for vending or advertisements. Other vending machines, in particular beverage vending machines, have X-Y product retrieval and delivery mechanisms and a glass front or large liquid crystal display, but may include an access port 105 to the side as shown in FIG. 1, at a height convenient to the customer for product retrieval without bending over.

Those skilled in the art will recognize that the complete structure of a vending machine is not depicted in the drawings, and the complete details of the structure and operation of the vending machine is not described herein. Instead, for simplicity and clarity, only so much of the structure and operation of a vending machine as is unique to the present disclosure or necessary for an understanding of the present invention is depicted and described.

Figure 2:
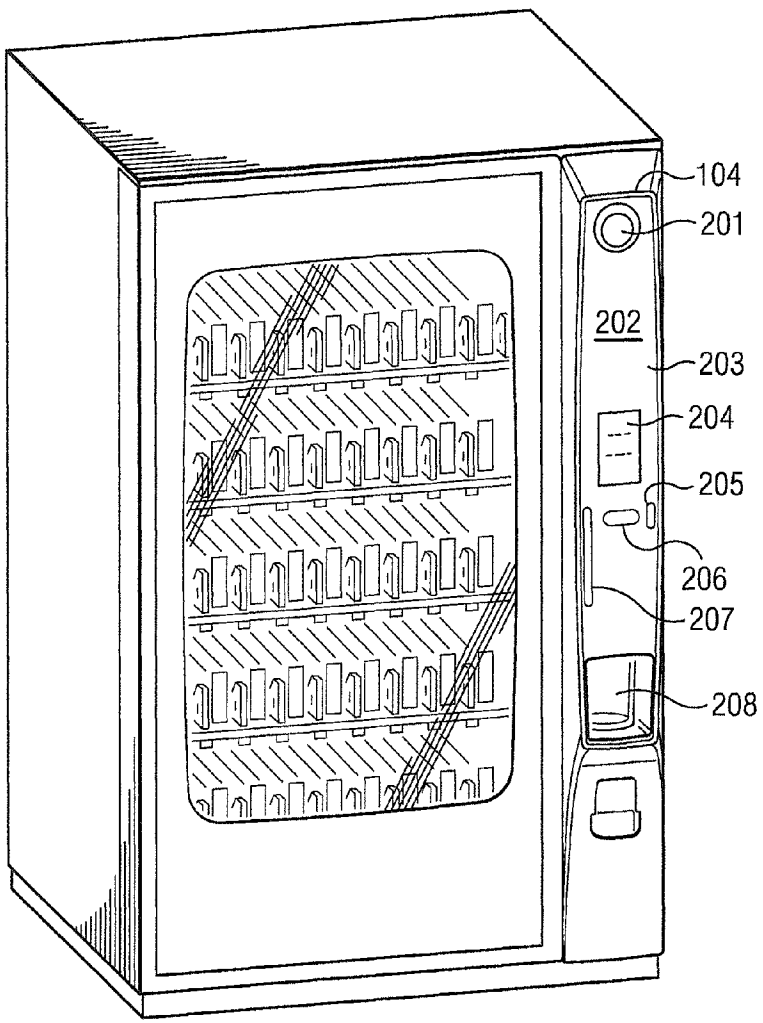
FIG. 2 illustrates aspects of an intuitive and attractive customer user interface for which synchronized illumination may be implemented according to one embodiment of the present disclosure.
Figure 3:
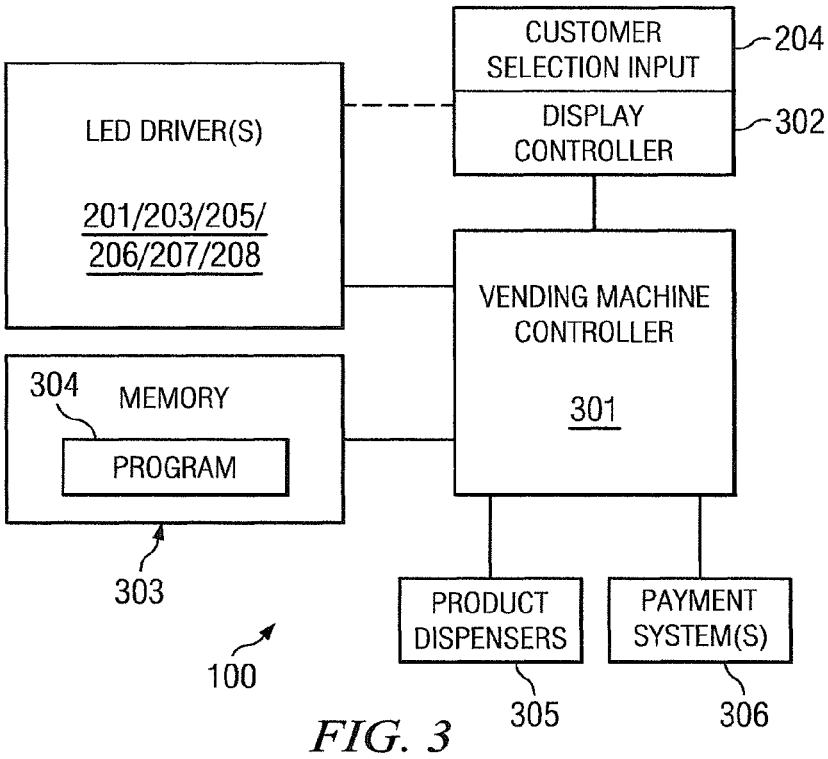
FIG. 3 is a block diagram of a control system within a vending machine implementing an intuitive and attractive customer user interface for which synchronized illumination may be implemented according to one embodiment of the present disclosure.

FIG. 2 illustrates aspects of an intuitive and attractive customer user interface for which synchronized illumination may be implemented according to one embodiment of the present disclosure. FIG. 3 is a block diagram of a control system within a vending machine implementing an intuitive and attractive customer user interface for which synchronized illumination may be implemented according to one embodiment of the present disclosure. The customer user interface 104 includes a backlit branding element 201 and a printed graphical branding "pill" 202. Light emitting diode (LED) accent lighting 203 surrounds a periphery of the customer user interface area 104.

Vending machine 100 includes a programmable vending machine controller (VMC) 301 of the type known in the art. Coupled to and communicating with VMC 301 is a display controller 302 for the customer selection input device 204. The customer selection input device 204 is preferably provided by a touch-screen liquid crystal display (LCD) display and input. Suitable touch-screen display devices and the associated controllers for use as customer selection input device 204 and display controller 302 are known in the art. The display controller 302 renders content for display on the customer selection input device 204 and detects customer contact with the touch screen for the customer selection input device 204. LED-lit bezels 205, 206 and 207 are provided for the coin input slot, bill validator/recycler access slot, and magnetic card reader slot, respectively. LED illumination 208 is also provided for the delivery receptacle behind the access port 105.

The vending machine control 301 is coupled to and communicates with driver circuits for each of LED illumination sources 201, 203, 205, 206, 207 and 208, and is programmable to select the timing and color of illumination output by those sources as described in further detail below. Display controller 302 may optionally control one or more of LED illumination sources 201, 203, 205, 206, 207 and 208, either sporadically in addition to control by VMC 301 or regularly based on commands received from VMC 201. The bezel illumination sources 205, 206 and 207 may be controlled directly by VMC 301 or as part of payment devices 306 (e.g., a coin mechanism, a bill recycler or bill validator, and a magnetic stripe card reader) coupled to and communicating with VMC 301.

The user interface 104 includes a customizable light emitting diode (LED) branding zone backlit by LED illumination source 201. The branding zone is a unique backlit zone that can be easily customized by operators by replacement of the graphic that is backlit by the LED illumination source 201. The color and timing of the backlighting is fully controllable by the operator through appropriate selection of options modifying the control program 304 residing in memory 303. (Although depicted in FIG. 3 as separate from VMC 301, memory 303 may actually be part of the same integrated circuit as VMC 301).

A customizable branding "pill" 202 is located in user interface area 104. The pill 202 is a one-piece graphic occupying the interior portion of user interface area 104, surrounded by the accent LED lighting 203 in the exemplary embodiment and itself surrounding the LCD display 204, the illuminated bezels 205, 206 and 207 and the access port 105 opening for the delivery receptacle. Pill 202 may be easily exchanged and can be fully customized by the operator.

LED accent lighting 203 surrounds the periphery of user interface area 104, defining a branding zone. Accent lighting 203 is fully programmable to select different colors and to implement customer-attract functions or interaction with the customer when a promotion is being made. The customer-attract sequence or customer engagement can be altered from a default or idle state based upon the proximity of a customer, via a proximity sensor or camera (not shown).

The payment "pill" design shapes (e.g., the illuminated bezels around the coin slot, bill validator access slot and card reader swipe mechanism) match the same design shape as corresponding "buttons" on the LCD screen to create a new level of intuitive interaction. Thus, for example, the user interface control 209 employed on LCD screen 204 to represent the bill validator or recycler portion of the payment devices 306 has the same shape and color as the illuminated bezel 206 around the bill validator access slot. The individual programmable payment zones are thus linked back to the user interface (touch screen). During operation, bezels around the payment devices are fully illuminated to create additional level of intuitive interaction, and the illumination color, level (intensity or brightness) and pattern (e.g., steady or flashing) of the illumination may be changed or customized. For example, the illumination for the bezel around a payment device (for instance, the bill recycler) can turn to red and/or flash when the bill recycler is not in service. The changes in illumination color, level or pattern correspond to usage instructions displayed on the touch screen display 204.

A unique flush glass appearance for user interface 104 is created by applying a second layer of glass over the active glass display (e.g., over the touch screen display 204 and the remaining areas of the user interface display). This second glass layer creates a custom finished look that allows the brand overlay and the full touch surface to remain flush. That is, static graphics may be embossed or painted on a surface of second glass layer.

The user interface 104 includes a fully integrated and flush mounted card reader swipe mechanism and bezel and bill recycler access slot and bezel, providing a flush outer appearance of the cash/card swipe systems.

Banks of vending machines require the exchange of information to perform a variety of functions. Mesh networking has been previously applied to the telemetry of operational data via a vending machine network to a network operation center, with operability or stock levels being prime examples. While the transfer of operational data via a vending machine network is straightforward, due to the critical time windows required, time synchronization of coordinated activities between vending machines in a vending machine bank is not.

As vending machine banks share styling concepts such as accent light piping, the use of consumer directed input/output devices drives time synchronization requirements. For example, it may be desirable for a bank of vending machines to have lighting patterns that are coordinated across the bank to attract customer attention or facilitate multiple sales from different machines within the bank. A lighting pattern that has one machine out of synchronization with its peers would be discordant and highly noticeable to the consumer. Therefore, for an effective style, ensuring that the lighting patterns of the vending machine bank are in tight time synchronization is essential. Dimming, "breathing," streaming, and sequencing of lighting elements (including any combination of the light pipes and/or light emitting diode backlighting or illumination described above) thus require accurate synchronization by the machines.

Other examples of the need for time synchronization in a vending machine network include coordinated display of graphical content, including promotions and advertisements that must run in pre-defined sequences across the bank, and coordinated operation of consumer selection panels, including selection buttons that directs a sequence in unison and/or enable/disable in harmony based on specific activities.

Figure 4:
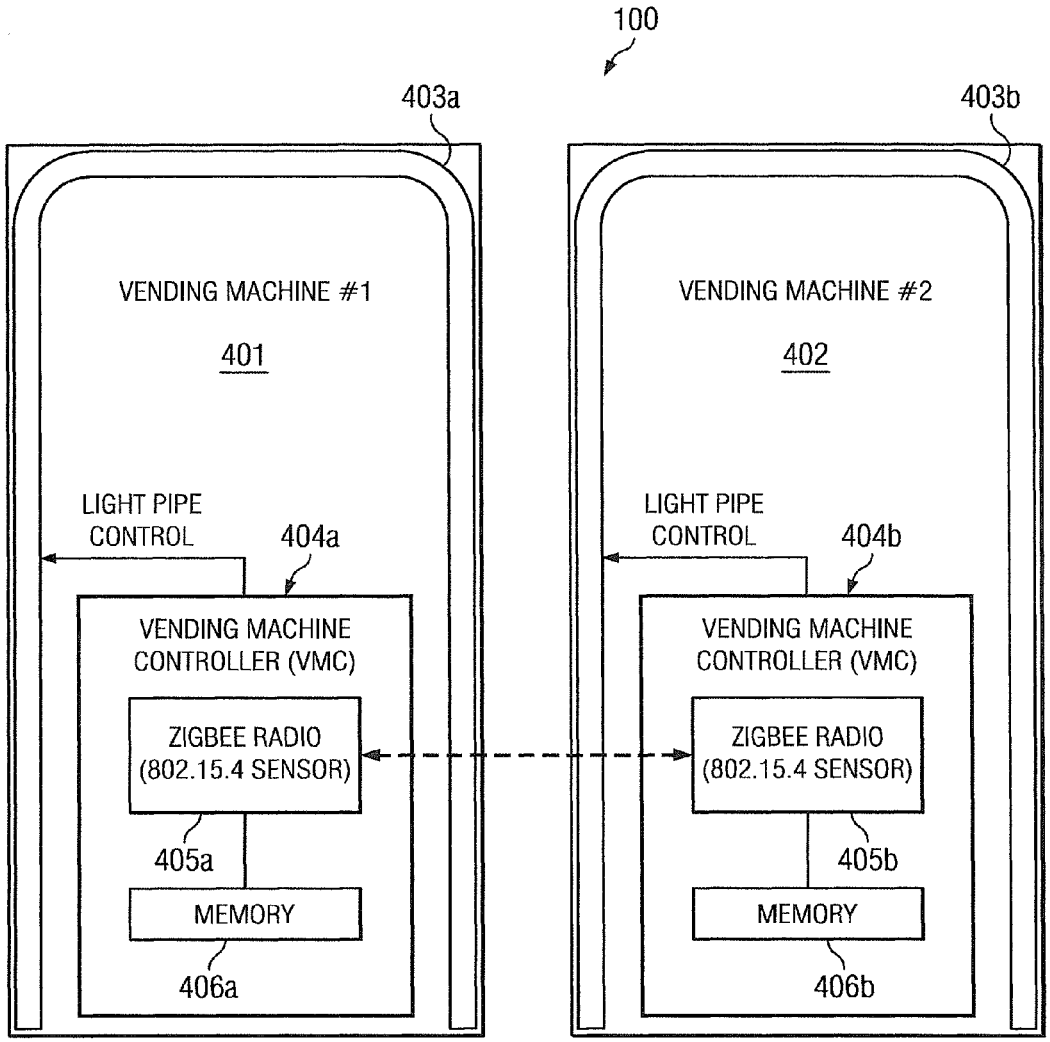
FIG. 4 is a simplified view illustrating a vending machine network with accurate time synchronization according to one embodiment of the present disclosure.

FIG. 4 is a simplified view illustrating a vending machine network with accurate time synchronization according to one embodiment of the present disclosure. The vending machine network 400 includes a first vending machine 401 and a second vending machine 402. Each vending machine 401, 402 in the exemplary embodiment includes an identical light pipe 403*a*, 403*b*, respectively, along both front sides and the front top thereof. Each vending machine 401, 402 also includes a vending machine controller (VMC) 404*a*, 404*b* for controlling illumination (on/off, color, level or brightness, steady or flashing patterns, etc.) and an Institute for Electrical and Electronic Engineers (IEEE) 802.15.4 Zigbee radio sensor 405*a*, 405*b*. Each vending machine 401, 402 additionally includes memory 406*a*, 406*b* which is accessible to the VMCs 404*a*, 404*b* for storing a wireless protocol stack, routing information, as well as application objects or firmware. In various embodiments, the memory 406*a*, 406*b* resides within the VMC 404*a*, 404*b*, while in others, the memory 406*a*, 406*b* resides separately, but in communication with the VMC 404*a*, 404*b*. Although not shown in FIG. 4, each vending machine 401, 402 additionally includes a display controller 302, which communicates with the VMC 404, as previously described.

Those skilled in the art will recognize that the complete structure of a vending machine is not depicted in the drawings, and the complete details of the structure and operation of the vending machine is not described herein. Instead, for simplicity and clarity, only so much of the structure and operation of a vending machine as is unique to the present disclosure or necessary for an understanding of the present invention is depicted and described.

Using established time synchronization protocols within physical network stacks such as 802.15.4, time critical activities are synchronized across a bank of vending machines (or "peers"). Logical network stacks, such as Zigbee, are not sufficient for guaranteeing the tight time requirements to enable time synchronization of activities, since network latency could prevent the establishment of the harmonious activities required. However, while the logical network can be used as a command protocol (i.e., "what do to"), the network stack is responsible for timing (i.e. "when to do it").

Figure 5:
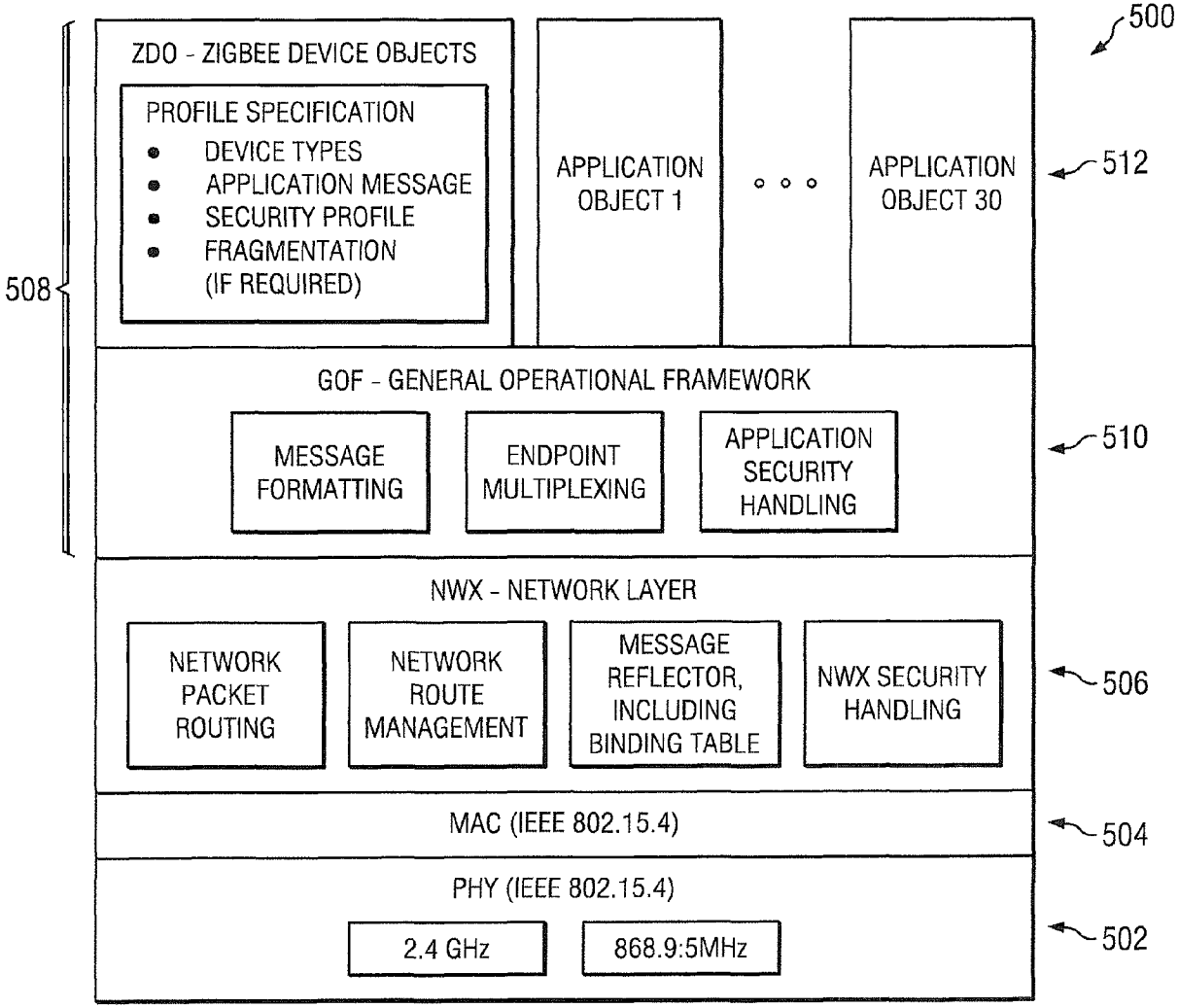
FIG. 5 is a diagram of different application and network layers employed in each vending machine in implementing a vending machine network with accurate time synchronization according to one embodiment of the present disclosure.

FIG. 5 is a diagram 500 of different application and network layers employed in each vending machine in implementing a vending machine network with accurate time synchronization according to one embodiment of the present disclosure. A Zigbee network, residing on top of an 802.15.4 physical stack according to the Open Systems Interconnection (OSI) model, lends itself well to this solution. The 802.15.4 physical stack includes two layers. Physical (PHY) 502 and media access control (MAC) 504 layers provide guaranteed time slots (GTSs) for communication and beaconing, which can be used for the time synchronization requirements. Network layer 506 and host layers 508 provide the facilities to exchange information regarding what the peers should perform.

The host layers 508 in a Zigbee network include a general operation framework (GOF) layer 510 and a Zigbee device object (ZDO) layer 512. The GOF layer 510 serves as an interface between applications above and the rest of the protocol stack below. Messaging format, endpoint multiplexing, and application security handling information are all resident in the GOF layer 510. The ZDO layer 512 includes application profiles or objects, along with device types, a security profile, and fragmentation information.

The four basic frame types defined in 802.15.4 are data, acknowledgement, MAC command, and beacon. Most relevant to this disclosure are beacon frames, which can be used in mesh networks to keep all nodes in the mesh network synchronized, while using minimal energy. In addition to synchronization, beacons are used to identify the home-area network (HAN) and describe the structure of a superframe, which is used to control channel access in beacon-enabled networks.

An example of using upper and lower OSI layers for synchronization is related to the beacon frame. According to various embodiments, a sequence pattern, for example sequence pattern 1, can be selected and stored in the beacon frame. Therefore, the beacon frame provides the Zigbee network with the ability to exchange information about the sequence pattern to use. The 802.15.4 network is used to define the starting time element as well as keep the devices synchronized. In particular, the superframe can be set up to transmit beacons at pre-determined time intervals that are multiples of 15.38 milliseconds up to 252 seconds. Sixteen equal-width time slots are also provided between beacons for contention-free channel access in each time slot. While the channel access in each time slot is contention-based, there can be up to seven GTSs per beacon interval.

There are three types of devices used in Zigbee networks. A network coordinator is the most advanced of the three. A full function device (FFD) is a Zigbee device which supports all 802.15.4 functions, and can perform network routing functions or act as a user interface. The third device type is a reduced function device (RFD) which performs only a limited functionality and designed for cost sensitive and less complex applications.

According to various embodiments, a vending machine network can be configured using a network coordinator or an FFD device to communicate to multiple RFD devices located in a plurality of vending machines. An example RFD device is a Zigbee radio sensor which is in communication with a vending machine controller. Based upon the communication, a light pipe located in each of the vending machines will know exactly what action it needs to take as well as exactly what time to perform the action.

Figure 6:
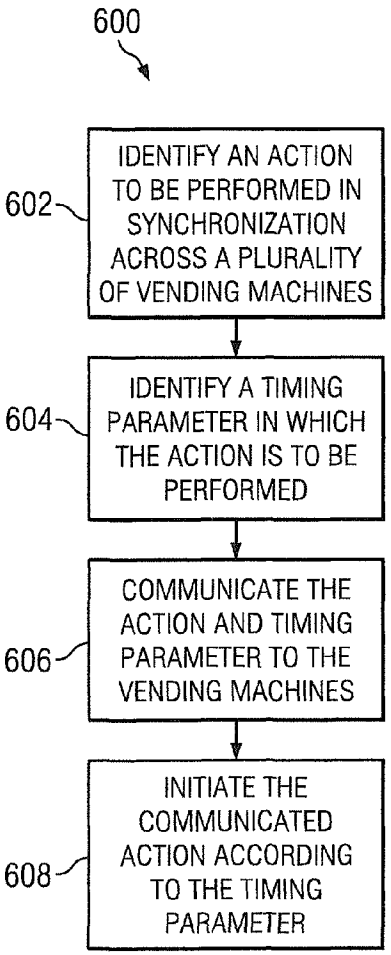
FIG. 6 is a flowchart of one embodiment of a method for time synching coordinated activities across a bank of vending machines.

FIG. 6 is a flowchart 600 of one embodiment of a method for time synching coordinated activities across a bank of vending machines. In Step 602, an action to be performed in synchronization across a plurality of vending machines is identified. The action can be represented by an application object residing in the top part of a Zigbee protocol stack, and information regarding the action can be placed into the MAC layer, or specifically in the beacon frame for communicating to other vending machines in communication with the vending machine.

In disclosed embodiments, the action to be performed is related to lighting, such as ensuring lighting patterns of vending machine banks are coordinated. In other disclosed embodiments, the action is the coordinated display of graphical content such as advertisements or promotions. For example, it may be advantageous for various advertisements or promotions to be presented to a consumer using the vending machine. If the consumer initiates the purchase of a snack, a promotion may be displayed to the consumer offering a discount on, or encouraging the purchase of a beverage.

In addition to lighting and promotional type actions, in another embodiment the action is a coordinated operation of consumer selection panels, including selection buttons that are enabled or disabled across the plurality of vending machines. In this embodiment, a user inserting payment on one machine is given the option to purchase items in any of the vending machines that are in communication with each other.

In various embodiments more than one action can be identified and can occur simultaneously or in turns with other identified actions. For example, in a disclosed embodiment, a coordinated light display can occur between vending machines while an advertisement is being displayed to a consumer selecting products across a bank of vending machines.

In Step 604, a timing parameter in which the action is to be performed is identified. As described above, the Zigbee (802.15.4) network is used to define the starting time element as well as keep the devices synchronized. Using a superframe, beacons are transmitted at pre-determined time intervals, with sixteen equal-width time slots being provided between beacons for contention-free channel access in each time slot. Additionally, there can be up to seven GTSs per beacon interval. In selecting timing parameters in disclosed embodiments, various lighting and display effects can be created as described herein.

The action and the timing parameter information is communicated via a radio sensor to the plurality of vending machines in Step 606. In various embodiments, the radio sensor is a Zigbee Radio (802.15.4 sensor) located in each vending machine. Based upon the timing parameter identified in step 604, communication occurs between the radio sensors indicating what action to do, as well as the timing for the action. The radio sensors can be FFDs or RFDs, depending upon the complexity of the action to occur as well as the radio sensors place in the network.

In Step 608 a vending machine controller (VMC) initiates the communicated action according to the timing parameter information to achieve a desired effect. The VMC within each vending machine can work in coordination with the radio sensor in each vending machine to control the synchronization actions as well as the remaining functions of the vending machine.

While the exemplary embodiment employs a Zigbee network to distribute identification of the actions that are to be performed based on a particular timing synchronization signal by the PHY/MAC layers, alternatively Bluetooth, RS485, RS232, or Ethernet could be used for that purpose.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. A vending machine, comprising:

an element requiring actuation in time synchronization with an other vending machine;

an accessible memory;

a Zigbee 2012 specification radio controller; and a vending machine configured to:

identify an action to be performed in synchronization with the other vending machine, identify a timing parameter for the action is to be performed, communicate the action and the timing parameter information via the Zigbee 2012 specification radio controller to the other vending machine, and initiate the communicate action according to timing control information received via the Zigbee 2012 specification radio controller.

2. The vending machine of claim 1, wherein communicating the action and timing parameter information further comprises executing a network protocol including an application layer specifying actions to be performed in synchronization and physical and media access control layers providing synchronization signals for coordinated timing of the actions specified by the application layer.

3. The vending machine of claim 2, wherein the network protocol is Institute for Electrical and Electronic Engineers (IEEE) 802.15.4.

4. The vending machine of claim 1, wherein communicating the action is performed by a beacon frame in a media access control (MAC) sublayer.

5. The vending machine of claim 1, wherein communicating the timing parameter is performed in the physical sublayer.

6. The vending machine of claim 1, wherein the action to be performed in synchronization comprises coordinated illumination within the vending machine and the other vending machine to provide a desired effect selected from: dimming, breathing, streaking and sequencing, and wherein the desired effect is applied to any combination of light pipes, backlighting, and internal illumination.

7. The vending machine of claim 1, wherein the action to be performed in synchronization further comprises a coordinated display of graphical content, wherein the graphical content is an advertisement or promotion.

8. The vending machine of claim 1, wherein the action to be performed in synchronization further comprises coordinated operation of consumer selection panels.

9. The vending machine of claim 8, wherein the coordinated operation of consumer selection panels allows a consumer to select a product in each of the vending machine and the other vending machine and pay for both products in one of the vending machine and the other vending machine.

10. The vending machine of claim 1, wherein the vending machine controller is further configured to:

identify a second action to be performed in synchronization across a plurality of vending machines, and identify a second timing parameter in which the second action is to be performed.

11. A method for time synching coordinated activities across a bank of vending machines, the method comprising:

identifying an action to be performed in synchronization across a plurality of vending machines;

identifying a timing parameter in which the action is to be performed;

communicating the action and the timing parameter information via a radio sensor to the plurality of vending machines; and initiating, by a vending machine controller, the communicated action according to the timing parameter information to achieve a desired effect.

12. The method of claim 11, wherein communicating the action and timing parameter further comprises using time synchronization protocols within physical network stacks.

13. The method of claim 12, wherein the time synchronization protocol is the Zigbee 2012 specification.

14. The method of claim 11, wherein communicating the action and timing parameter information includes executing a network protocol including an application layer specifying actions to be performed in synchronization and physical and media access control layers providing synchronization signals for coordinated timing of the actions specified by the application layer.

15. The method of claim 11, wherein communicating the action comprises communicating by a beacon frame in a media access control (MAC) sublayer.

16. The method of claim 11, wherein the action to be performed in synchronization comprises coordinated illumination within multiple vending machines to provide a desired effect, wherein the desired effect comprises one or more of: dimming, breathing, streaking, or sequencing, and wherein the desired effect is applied to any combination of light pipes, backlighting, and internal illumination.

17. The method of claim 11, wherein the action to be performed in synchronization further comprises a coordinated display of graphical content, wherein the graphical content is an advertisement or promotion.

18. The method of claim 11, wherein the action to be performed in synchronization further comprises the coordinated operation of consumer selection panels.

19. The method of claim 18, wherein the coordinated operation of consumer selection panels allows a consumer to select a product in a vending machine separate from, but in communication with, a vending machine in which payment was inserted.

20. The method of claim 11, further comprising:

identifying a second action to be performed in synchronization across a plurality of vending machines; and identifying a second timing parameter in which the second action is to be performed.

* * * * *